United States Patent [19]

Noomen et al.

[11] 4,098,928

[45] Jul. 4, 1978

[54] METHOD OF COATING UNDERWATER METAL SURFACES

[75] Inventors: Arie Noomen, Voorhout; Leendert Anton Kik, Wassenaar, both of Netherlands

[73] Assignee: Akzo N.V., Arnhem, Netherlands

[21] Appl. No.: 731,575

[22] Filed: Oct. 12, 1976

[30] Foreign Application Priority Data

Oct. 14, 1975 [NL] Netherlands ..... 7512036

[51] Int. Cl.[2] ..... B05D 1/12; B05D 1/36

[52] U.S. Cl. ..... 427/203; 427/240

[58] Field of Search ..... 427/203, 240, 405, 406, 427/409, 410, 421; 428/416, 457, 461, 470; 29/195

[56] References Cited

FOREIGN PATENT DOCUMENTS

| | | |
|---|---|---|
| 986,064 | 3/1965 | United Kingdom. |
| 1,177,554 | 1/1970 | United Kingdom. |

*Primary Examiner*—James R. Hoffman

*Attorney, Agent, or Firm*—Stevens, Davis, Miller & Mosher

[57] ABSTRACT

A coating system comprising a primer and a top coat is applied to a steel surface positioned under water or in the splash zone in such a way that successively carrier particles covered with the priming material are caused to collide with the steel surface and a top coat is applied to the steel surface thus treated.

15 Claims, No Drawings

METHOD OF COATING UNDERWATER METAL SURFACES

BACKGROUND OF THE INVENTION

The present invention relates to a method for applying a coating system comprising a primer and a top coat to an underwater steel surface or a steel surface positioned in the splash zone. The method particularly relates to the treatment of parts of drilling equipment, pipe lines, piling structures for bridges and jetties, ship's hulls and other steel structures placed in or below water.

It is known that parts of steel surfaces that are very much subject to corrosion are particularly those that are in the vicinity of the waterline. In sea water and in rivers and reservoirs, where there is a fluctuating water level, the corrosion zone is particularly found between the lowest water level and the highest water level. This is partly to be attributed to the wave effect and the relatively high concentrations of oxygen near the water surface. The effect on the steel surface will increase with temperature, so that in tropical areas corrosion will be worse. It is of importance that the steel surface under the above conditions should continuously be protected from corrosion, which calls for regular maintenance. Where possible the maintenance will preferably be carried out above water, which facilitates working and makes it possible to obtain better results because of the absence of the strongly disturbing influence of water.

In many cases, however, it is not possible for the steel structures to be raised above water or to use cofferdams because the steel structures are anchored in the bottom and/or are of a prohibitive size. This particularly applies to off-shore drilling rigs and piling structures for bridges and jetties.

The maintenance of ship's hulls below the water line requires the use of a dry dock, so that the ship must be withdrawn from service and moreover very high docking charges are to be paid. For these reasons, too, one is very often obliged to proceed to underwater applying or repairing of the coating.

The coating compositions that are suitable to be applied to underwater steel surfaces can be divided into two main types. The one type has a putty-like consistency and is manually applied by divers so as to form a coating having a thickness in the range of, say, 1 to 20 or 30 mm or higher (see British Pat. No. 986 064). The adhesion of the thick coating to a steel substrate mainly being effected mechanically, it is according to said patent specification possible for the coating to be applied to a rusty substrate and there is no need for the substrate to be completely freed from rust and other contaminations.

Apart from the fact that in this way it has not been found possible in practice for the steel substrate to be sufficiently protected from corrosion, this method is time consuming and the costs of the material and the labour involved are very high.

The other type, which consists of a physically and/or oxidatively drying binder and a water-soluble organic solvent for it, can be applied by brush to previously cleaned steel objects (see British Pat. No. 963 906). To ensure that the coating will adhere to a steel substrate, the coating composition also contains an aliphatic amine with at least 13 carbon atoms or an aliphatic diamine. This type, however, is found to offer insufficiently effective protection from corrosion as a result of a too high porosity of the top coat.

In practice it has been found (see Journal of Paint Technology, Vol. 47, No. 600, January 1975, p. 40–42, and U.S. Pat. No. 3,860,987) that to ensure an adhesion of a coating composition to a water wetted surface two essential conditions must be met:

1. the surface must be clean, i.e. it must be freed from growths, corrosion products and other contaminations. This can be done with, for example, a wire brush, a scaling hammer or a needle gun. The most effective method, however, is by blasting with, say, sand or corundum, it being aimed at attaining the degree of cleanness SA 2 in accordance with the Swedish standard SIS 05 5900–1976.

2. the boundary layer between the water and the metal surface to be treated must be broken. In practice it has been found that this can be done by brush or by roller only for a short time after the cleaning operation; in sea water of 30° C., for instance, for 15 minutes. Since the underwater coating is mostly done by divers, the rate of application being very slow then, this time limit forms a great problem.

An object of the invention is to provide a method in which the time available for applying a top coat is sufficiently long, for instance over 2 to 3 hours. Another object is the possibility of using a coating composition for applying a top coat which need not contain any special additives to promote the adhesion of the top coat to the substrate. A further object is to pre-treat the surface in such a way that the top coat can be applied with relatively simple means, for instance a brush, a roller, a rotating brush or a gun. An additional object is to apply properly adhering, thin top coats having a thickness of, for example, 100 to 750 $\mu$m.

In accordance with the present invention, there is provided a method for applying a coating system comprising a primer and a top coat to a steel surface positioned underwater or in the splash zone, in which the primer is applied to the steel surface as a result of a collision between the steel surface and the carrier particles covered with the priming material, after which the top coat is applied. Although the primer may consist of any suitable material, it preferably contains a resin-like binder compatible with the top coat.

To the coated carrier particles a high kinetic energy is imparted in the same way as is done in sand blasting, by incorporation in a gas-, vapour-, or liquid stream or mechanically as by centrifugal blasting. In this way there will form a hydrophobic priming coat. Subsequently, the top coat can be applied with simple coating applicators such as a brush or roller, because the metal has assumed a lyophilic instead of a lyophobic character.

As examples of suitable resin-like binders enveloping the carrier particles may be mentioned epoxy resins, polyamide resins and coumarone-indene resins; preferably an epoxy resin or a coumarone-indene resin is used. From the point of view of the prevention of corrosion a film-forming alkaline mixture of an alkaline earth metal salt of an organic sulphonic acid and an alkaline earth metal carbonate has turned out to be a very favourable binder. Preferably the alkaline earth salts are calcium salts. More preferably the binder comprises a mixture of calcium carbonate and the calcium salt of an alkyl phenyl sulphonic acid having an alkyl group containing 22 carbon atoms. Also suitable for use are mixtures of the above-mentioned binders. The afore-indicated binders are compatible with a top coat having a basis of an epoxy resin. If a top coat having a basis of, say, an unsaturated polyester resin or acrylate resin is desired, then a copolymer of styrene and an acrylate monomer such as methyl methacrylate and/or butyl acrylate is suitable to be used as binder for the primer.

As suitable carrier materials may be mentioned inorganic materials such as glass beads, copper slag, and aluminium oxide granules. Although it is preferred to employ an inorganic material which has more preferably a specific gravity higher than that of water, it is also possible to use materials having a lower specific gravity, such as beads of thermoplastic polymers, e.g. polyethylene, provided that in the water the particles have a sufficiently high speed. Besides the resin-like binder the primer may contain anti-corrosive compounds or fillers which increase the path of penetration of water to the substrate. As examples of suitable anticorrosive compounds may be mentioned the metallic powders known to be used in painting processes and corrosion inhibitors which are difficultly soluble in water.

The metallic powders to be used should be less noble than the steel substrate. Powders of zinc or magnesium or alloys of these metals are the most usual metallic powders for steel. Of the other types of anticorrosive substances it is required that they are not or only slightly soluble in water. Most corrosion inhibitors will therefore be less suitable for the application according to the invention because their effectiveness is actually based on water solubility. Very suitable inhibitors are the heavy metal salts such as lead salts and/or zinc salts of organic nitro compounds such as those of a nitrated aromatic carboxylic acid having 7 to 14 carbon atoms, like nitrobenzoic acid, nitrophthalic acid, nitroterephthalic acid, 3-nitro-2-methyl-terephthalic acid, 5-nitroisophthalic acid and nitronaphthalene dicarboxylic acid. Fillers which increase the path of penetration to the substrate are generally flake-shaped, for instance: micro talc, micro mica and micaceous iron oxide and stainless steel flakes. Other fillers may, of course, also be used. The maximum time between applying the primer and the top coat correlates with the anticorrosive effect of the primer. This effect is dependent on the nature of the resin-like binder and the thickness of the coat applied and also on the anticorrosive substances or fillers added, if desired, to the binder which increase the path of penetration of water to the substrate.

It is preferred that the top coat to be applied to the primer should be free from pores in order that a satisfactory inhibition of corrosion may be obtained. As a result, the choice of binder for the top coat is in practice limited to solventless resins or resins containing a reactive solvent. As binders especially epoxy resins but also unsaturated polyester resins and acrylate resins may be used. To obtain a satisfactory protection a coating thickness of a in general 100–750 μm is sufficient. The top coat may be applied in any suitable manner, for instance by brush, roller or projection, and, if desired in various steps.

EXAMPLES I - IX

Coating the carrier particles with the primer.

In a rotating drum the carrier material is, with continuous mixing, coated with a binder to which the substances to be mentioned hereinafter and, where desired, a solvent had been added. The mixture was kept up until the primer was homogeneously distributed over the surface of the carrier particles. In the cases where a solvent was present, drying was carried out at about 70° C. The epoxy resin is commercially available under the name Epikote 828 and has an equivalent weight of 180–210. The zinc powder is commercially available under the trade name Zincomox AAA and has a minimum zinc content of 98% and a particle size of 2–4 mμ. The coumarone-indene resin is commercially available under the trade name Necires BD 115 and has a softening point of 110° - 120° C and an iodine number of 80 - 100. The compound denoted as calcium sulphonate is a mixture of calcium carbonate and the calcium salt of an alkylphenyl sulphonic acid having an alkyl group containing 22 carbon atoms. The amounts given are in parts by weight.

| | | |
|---|---|---|
| I | silver sand (particle size <40 mesh) | 1000 |
| | epoxy resin | 5 |
| | zinc powder | 200 |
| II | electrocorundum (particle size <1 mm) | 1000 |
| | epoxy resin | 5 |
| | zinc powder | 200 |
| III | nylon powder (particle size <1 mm) | 400 |
| | epoxy resin | 5 |
| | zinc powder | 200 |
| IV | silver sand (particle size <40 mesh) | 1000 |
| | coumarone-indene resin | 60 |
| | toluene | 40 |
| | lead-zinc salt of 5-nitro isophthalic acid | 200 |
| V | silver sand (particle size <40 mesh) | 1000 |
| | calcium sulphonate | 25 |
| | toluene | 25 |
| | zinc powder | 200 |
| VI | silver sand | 1000 |
| | coumarone-indene resin | 60 |
| | toluene | 40 |
| VII | silver sand | 1000 |
| | calcium sulphonate | 50 |
| | toluene | 50 |
| | micro talc | 200 |
| VIII | silver sand | 1000 |
| | coumarone-indene resin | 60 |
| | toluene | 40 |
| | micro talc | 100 |
| IX | electrocorundum (particle size <1 μm) | 1000 |
| | epoxy resin | 5 |
| | zinc powder | 100 |
| | lead-zinc salt of 5-nitroisophthalic acid | 100 |

Composition of top coat:

| | | |
|---|---|---|
| epoxy resin | 50) | |
| rutile titanium white | 40) | basic paint |
| micro talc | 10) | |
| adduct having a basis of epoxy resin and xylenyl diamine and modified with benzyl alcohol | 30 | hardener |

To determine the effect of the various primers the following experiment was carried out:

Corroded steel plates were cleaned in aerated, flowing sea water of 30° C by sand blasting to the degree of cleanness SA 3 (SIS 05 5900–1967).

Subsequently, the maximum available time was determined to re-paint with the above-mentioned top coat a substrate, which had not been subjected to any further pre-treatments (control experiment) and substrates primed according to the invention with the aid of the compositions I through IX, the substrates having been cleaned with a Guyson type 40 sand blaster. The top coat was applied under water by brush to a thickness of about 250 μm.

Criteria for determining the maximum re-painting time were:

a. satisfactory adhesion bonding of the liquid top coat to the substrate.

b. visible absence of iron corrosion products c. proper adhesion of the cured top coat to the substrate.

Thus the following maximum re-painting times were determined:

| | |
|---|---|
| primer I | :18 hours |
| primer II | :18 hours |
| primer III | :18 hours |
| primer IV | : 8 hours |
| primer V | :24 hours |
| primer VI | : 4 hours |
| primer VII | : 6 hours |
| primer VIII | : 5 hours |
| primer IX | :18 hours |

In the control experiment the maximum re-painting time was ¼ hour.

What is claimed is:

1. Method for applying a coating system comprising a primer and a top coat to a steel surface positioned underwater or in the splash zone in which the primer is applied to the steel surface as a result of a collision between the steel surface and carrier particles covered with priming material forming a hydrophobic coat, after which the top coat is applied.

2. Method according to claim 1 in which the primer contains a resin-like binder compatible with the top coat.

3. Method according to claim 1 in which the primer contains an epoxy resin.

4. Method according to claim 1 in which the primer contains a coumarone-indene resin.

5. Method according to claim 1 in which the primer contains a film-forming alkaline mixture of an alkaline earth metal salt of an organic sulphonic acid and an alkaline earth metal carbonate.

6. Method according to claim 5 in which the alkaline earth salts are calcium salts.

7. Method according to claim 1 in which the primer also contains an anticorrosive compound.

8. Method according to claim 7 in which the anticorrosive compound is a metallic powder which is less noble than the steel substrate.

9. Method according to claim 8 in which the metallic powder contains zinc or a zinc alloy.

10. Method according to claim 8 in which the metallic powder contains magnesium or a magnesium alloy.

11. Method according to claim 7 in which the anticorrosive compound contains a heavy metal salt of an organic nitro compound.

12. Method according to claim 11 in which the organic nitro compound is a nitrated aromatic carboxylic acid having 7 to 14 carbon atoms.

13. Method according to claim 1 in which the primer contains a flake-shaped filler.

14. In a method of protecting a surface submerged in water against corrosion in the vicinity of the surface of the water, wherein the surface is cleaned and then coated with a corrosion-resistant coating material containing a synthetic resin, the step of covering the surface after cleaning with a primer which comprises impinging against said clean surface carrier particles coated with a primer composition compatible with the said corrosion-resistant coating in an amount whereby the clean surface becomes coated with said primer composition.

15. The method of increasing the time permitted between cleaning and coating of a surface submerged in water with a corrosion-resistant coating composition containing a synthetic resin which comprises covering the surface between cleaning and said coating step with a primer composition by impinging carrier particles coated with a primer composition which is compatible with said coating composition against the said surface until the surface is covered with the priming composition.

* * * * *